US008721354B2

(12) United States Patent
Liao et al.

(10) Patent No.: US 8,721,354 B2
(45) Date of Patent: May 13, 2014

(54) ELECTRONIC DEVICE

(71) Applicants: Yi-Ju Liao, Taipei (TW); Hsien-Tang Liao, Taipei (TW); Long-Cheng Chang, Taipei (TW); Po-Chin Yu, Taipei (TW); Wei-Chih Hsu, Taipei (TW)

(72) Inventors: Yi-Ju Liao, Taipei (TW); Hsien-Tang Liao, Taipei (TW); Long-Cheng Chang, Taipei (TW); Po-Chin Yu, Taipei (TW); Wei-Chih Hsu, Taipei (TW)

(73) Assignee: Compal Electronics, Inc., Taipei (TW)

( * ) Notice: Subject to any disclaimer, the term of this patent is extended or adjusted under 35 U.S.C. 154(b) by 2 days.

(21) Appl. No.: 13/670,482

(22) Filed: Nov. 7, 2012

(65) Prior Publication Data

US 2013/0122727 A1 May 16, 2013

Related U.S. Application Data

(60) Provisional application No. 61/560,308, filed on Nov. 16, 2011.

(51) Int. Cl.
*H01R 13/44* (2006.01)

(52) U.S. Cl.
USPC ..... 439/131

(58) Field of Classification Search
USPC ..... 439/136, 630, 131, 157, 372, 142
See application file for complete search history.

(56) References Cited

U.S. PATENT DOCUMENTS

| | | | | | |
|---|---|---|---|---|---|
| 1,733,196 | A * | 10/1929 | McCune | 439/131 |
| 2,441,643 | A * | 5/1948 | Mickler | 200/51.12 |
| 4,372,629 | A * | 2/1983 | Propst et al. | 312/223.6 |
| 4,647,832 | A * | 3/1987 | Fenne et al. | 320/111 |
| 4,763,300 | A * | 8/1988 | Yukawa | 365/52 |
| 4,959,020 | A * | 9/1990 | Di Rosa | 439/138 |
| 5,135,406 | A * | 8/1992 | Ishikawa | 439/131 |
| 5,326,140 | A * | 7/1994 | Randall | 292/47 |
| 5,598,319 | A * | 1/1997 | Lee | 361/679.33 |
| 5,864,294 | A * | 1/1999 | Hsu et al. | 340/635 |
| 6,275,385 | B1 * | 8/2001 | Sahara et al. | 361/752 |
| 6,377,451 | B1 * | 4/2002 | Furuya | 361/679.32 |
| 7,479,042 | B2 * | 1/2009 | Chen | 439/660 |
| 7,483,262 | B2 * | 1/2009 | Yin et al. | 361/679.01 |
| 7,713,074 | B2 * | 5/2010 | Poo et al. | 439/136 |
| 8,355,260 | B2 * | 1/2013 | Kang | 361/752 |
| 2005/0257231 | A1 * | 11/2005 | Hibi | 720/647 |

FOREIGN PATENT DOCUMENTS

| | | |
|---|---|---|
| TW | M380509 | 5/2010 |

* cited by examiner

*Primary Examiner* — Neil Abrams
*Assistant Examiner* — Phuongchi T Nguyen
(74) *Attorney, Agent, or Firm* — Jianq Chyun IP Office

(57) ABSTRACT

An electronic device includes a body, a door, and a connection module. The body has an opening located at a side of the body. The door is pivoted to the body and capable of rotating between an opening position and a closing position in relative to the body for exposing or covering the opening. The connection module is slidably connected to the body. When the door is rotated to the opening position in relative to the body and exposes the opening, the door drives the connection module to slide to a working position in relative to the body, and when the door is rotated to the closing position in relative to the body and covers the opening, the door drives the connection module to slide to a retracted position in relative to the body.

13 Claims, 10 Drawing Sheets

ELECTRONIC DEVICE

CROSS-REFERENCE TO RELATED APPLICATION

This application claims the priority benefits of U.S. provisional application Ser. No. 61/560,308, filed on Nov. 16, 2011. The entirety of the above-mentioned patent application is hereby incorporated by reference herein and made a part of this specification.

BACKGROUND OF THE INVENTION

1. Field of the Invention

The invention relates to an electronic device and more particularly to an electronic device with a concealable connection port.

2. Description of Related Art

In recent years, with the advance of technology industries, electronic products including notebook computers, smart phones, and tablet computers have appeared frequently in everyday lives. Types and functions of the electronic products have become increasingly diverse, and convenience and practicality of these electronic products result in popularity thereof. Specifically, the electronic products are equipped with connection ports to connect external devices, such as external hard drives, network cables, power supplies, and so forth. These connection ports are usually disposed on the outside of the electronic products, so that users may easily connect the external devices to the connection ports.

However, the connection ports disposed on the outside of the electronic products are exposed to the external environment for a long time and are thus likely to be contaminated by dust, which affects the functionality of the connection ports. In addition, the connection ports on the outside of the electronic products may pose a negative impact on the visual appearance of the electronic products. Hence, if the connection ports not in use may be hidden, satisfactory functionality of the connection ports and pleasant visual appearance of the electronic products may both be guaranteed.

According to the related art, the exposed connection ports may be covered by shielding structures (e.g., cover boards); however, users are required to remove the shielding structures by themselves while using the connection ports and then place the shielding structures back to their original positions after using the connection ports. These shielding structures lead to the inconvenient use of the connection ports.

SUMMARY OF THE INVENTION

The invention is directed to an electronic device with a hidden connection port for connecting an external device.

In an embodiment of the invention, an electronic device that includes a body, a door, and a connection module is provided. The body has an opening that is located at a side of the body. The door is pivoted to the body and capable of rotating between an opening position and a closing position in relative to the body for exposing or covering the opening. The connection module is slidably connected to the body. When the door is rotated to the opening position in relative to the body and exposes the opening, the door drives the connection module to slide to a working position in relative to the body; when the door is rotated to the closing position in relative to the body and covers the opening, the door drives the connection module to slide to a retracted position in relative to the body.

According to an embodiment of the invention, the electronic device further includes a sliding module that is connected to the body and the connection module, such that the connection module is slidably connected to the body through the sliding module.

According to an embodiment of the invention, the sliding module includes a sliding bracket and a sliding shaft. The sliding shaft is fixed to the body, the sliding bracket is fixed to the connection module and coupled to the sliding shaft, and the connection module slides along the sliding shaft through the sliding bracket, such that the connection module is driven to slide in relative to the body.

According to an embodiment of the invention, the door has a driving protrusion, and the connection module has a driving recession that is fit with the driving protrusion. When the door is rotated to the opening position in relative to the body, the driving protrusion is rotated in relative to the driving recession and drives the connection module to slide to the working position in relative to the body.

According to an embodiment of the invention, the door has a positioning recession, and the connection module has a positioning protrusion. When the door is rotated to the opening position in relative to the body and drives the connection module to slide to the working position in relative to the body, the positioning protrusion is mounted to the positioning recession, such that the connection module is fixed to the working position in relative to the body.

According to an embodiment of the invention, the electronic device further includes a lever. One end of the lever is pivoted to the body, and the other end of the lever is pivotally and slidably connected to the connection module. The lever has a driven portion, and the door has a driving portion. When the door is rotated to the closing position in relative to the body, the driving portion of the door pushes the driven portion of the lever, such that the connection module is driven to slide to the retracted position in relative to the body.

According to an embodiment of the invention, the number of the levers is two. The levers are respectively pivoted to two ends of the opening of the body and pivotally and slidably connected to two ends of the connection module, so as to restrict the connection module to slide in relative to the body in a direction perpendicular to a length direction of the connection module.

According to an embodiment of the invention, the connection module has a sliding groove, the lever has a sliding axle, and the lever is rotated and slid along the sliding groove through the sliding axle and drives the connection module.

According to an embodiment of the invention, the connection module includes a casing and at least one connection port. The casing is slidably connected to the body and connected to the door, and the connection port is disposed in the casing. When the door is rotated to the opening position in relative to the body, the door drives the connection module to slide to the working position in relative to the body to expose the connection port; when the door is rotated to the closing position in relative to the body, the door drives the connection module to slide to the retracted position in relative to the body to cover the connection port.

According to an embodiment of the invention, the connection module further includes a circuit board that is disposed in the casing, and the connection port is mounted on the circuit board.

According to an embodiment of the invention, the electronic device further includes an elastic member disposed between the body and the connection module. After the door in the closing position is rotated in relative to the body and drives the connection module to slide in relative to the body from the retracted position to a transition position to deform the elastic member, the elastic member drives the connection module to slide to the working position in relative to the body, so as to drive the door to rotate to the opening position in relative to the body; after the door in the opening position is rotated in relative to the body and drives the connection module to slide in relative to the body from the working position to the transition position to deform the elastic member, the elastic member drives the connection module to slide to the retracted position in relative to the body, so as to drive the door to rotate to the closing position in relative to the body.

According to an embodiment of the invention, the elastic member is a torsion spring.

According to an embodiment of the invention, the electronic device further includes a bottom bracket that is fixed into the body. The door is pivoted to the bottom bracket, and the connection module is slidably connected to the bottom bracket.

According to an embodiment of the invention, when an external connection head is connected to the connection module, the external connection head interferes with the door, such that the door stays at the opening position.

According to an embodiment of the invention, when the door is in the opening position, the door pushes the body away from a working surface.

In view of the above, the electronic device described herein has the body with an opening, and the door is pivoted to the body and capable of rotating in relative to the body for exposing or covering the opening. When the door is rotated in relative to the body and exposes the opening, the door drives the connection module to slide to the working position, such that the components (e.g., the connection port) on the connection module are exposed and may be used; when the door is rotated in relative to the body and covers the opening, the door drives the connection module to slide to the retracted position, such that the connection module is hidden, and that the components on the connection module may be prevented from dust contamination.

In order to make the aforementioned and other features and advantages of the invention more comprehensible, embodiments accompanying figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

Figure 1:
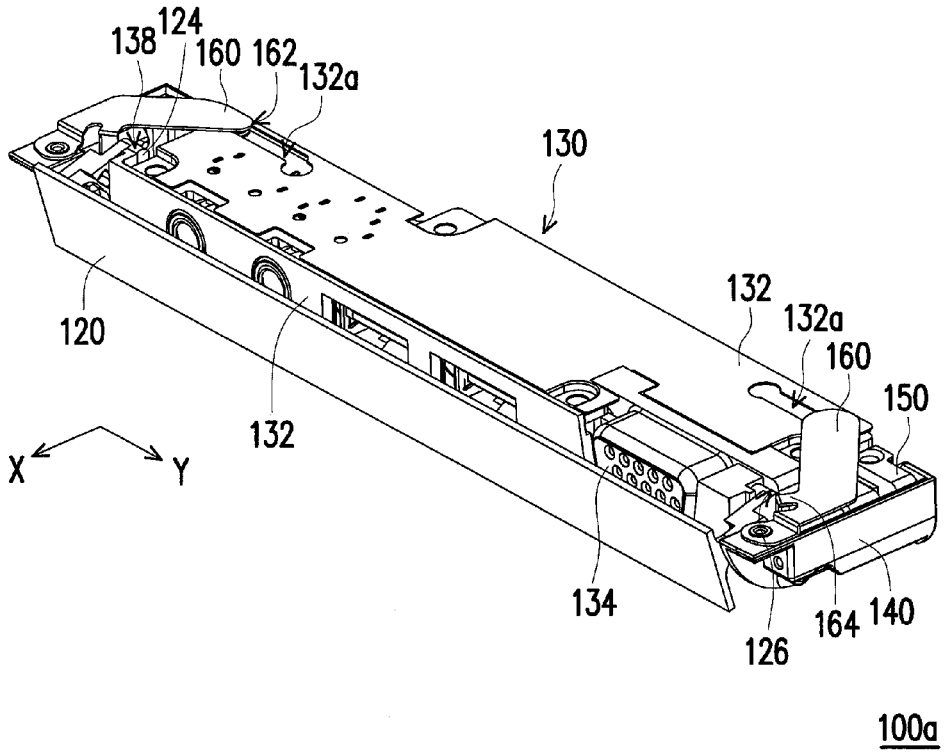
FIG. 1 is a perspective view illustrating a connection port assembly in an electronic device according to an embodiment of the invention.
Figure 2:
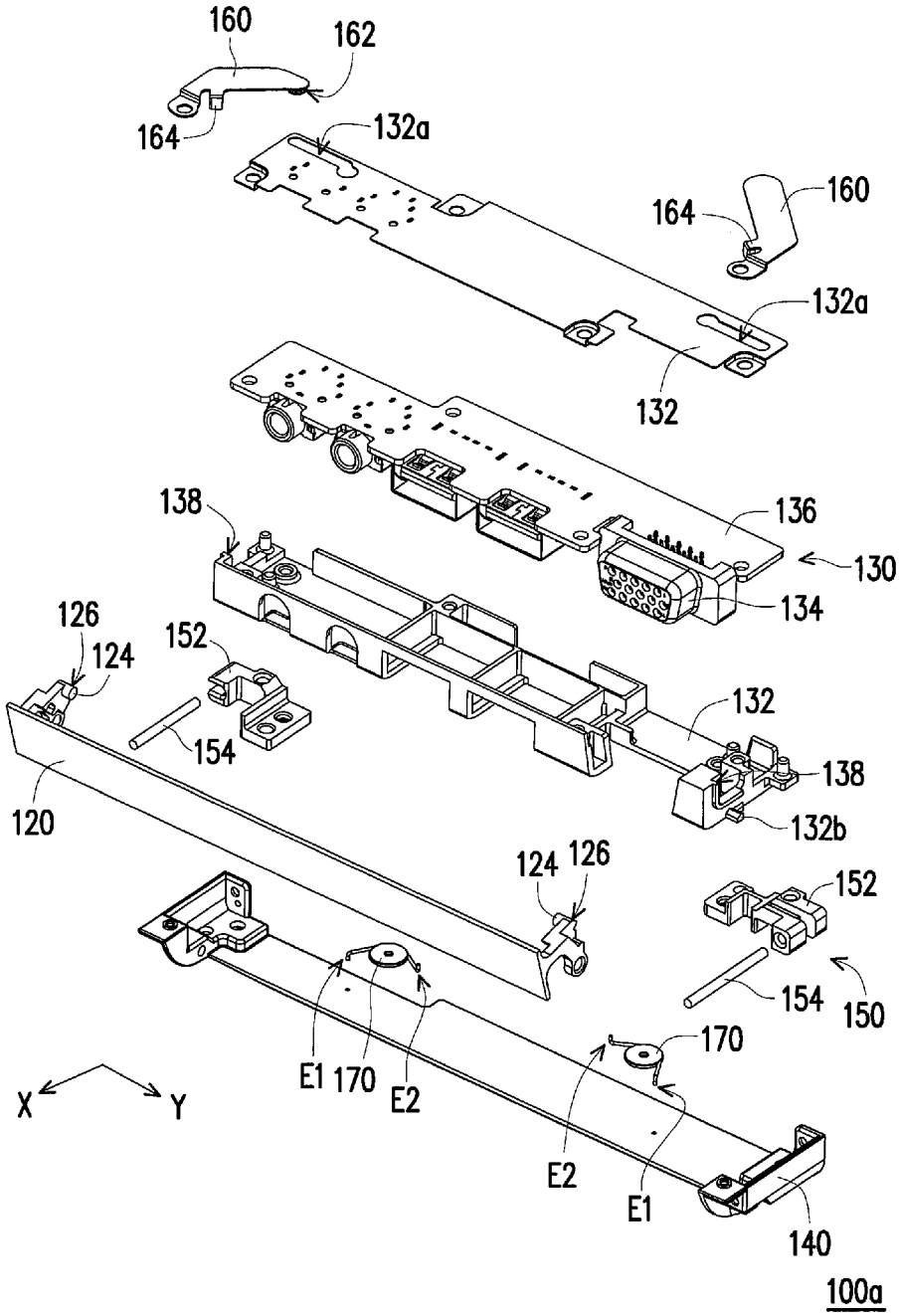
FIG. 2 is an exploded view illustrating the connection port assembly depicted in FIG. 1.
Figure 3A:
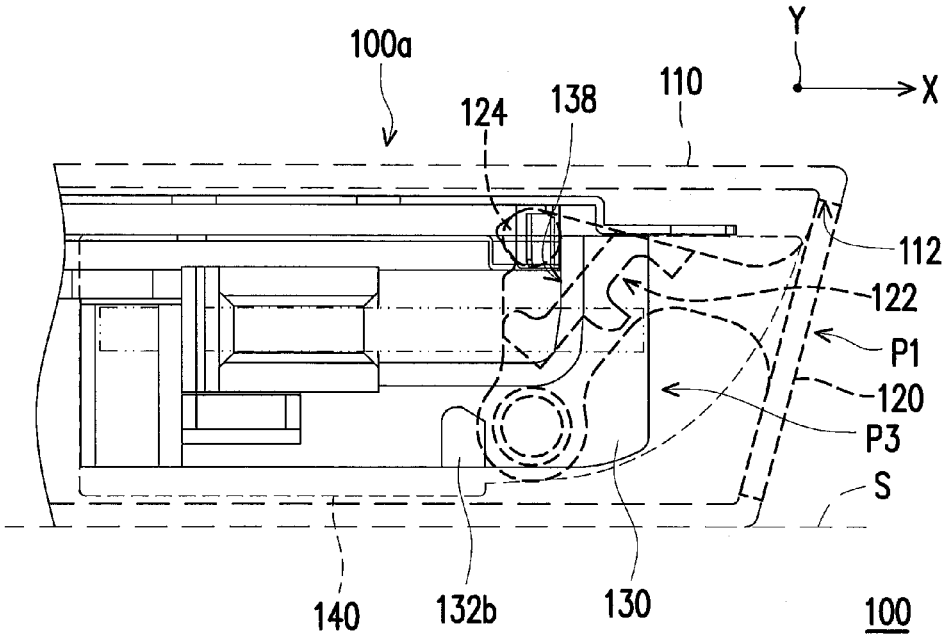
FIG. 3A is a partial side view illustrating the door of the electronic device depicted in FIG. 1.

FIG. 1 is a perspective view illustrating a connection port assembly in an electronic device according to an embodiment of the invention. FIG. 2 is an exploded view illustrating the connection port assembly depicted in FIG. 1. FIG. 3A is a partial side view illustrating the door of the electronic device depicted in FIG. 1. With reference to FIG. 1, FIG. 2, and FIG. 3A, the electronic device 100 described in the present embodiment includes a body 110 (shown in FIG. 3A) and a connection port assembly 100*a*. The body 110 has an opening 112 that is located at a side of the body 110. The connection port assembly 100*a* is located within the body 110 and may move in relative to the body 110. Hence, in the present embodiment, components in the connection port assembly 100*a* may move in relative to the body 110; however, the invention is not limited thereto.

In the present embodiment, the connection port assembly 100*a* includes a door 120, a connection module 130, and a bottom bracket 140. The bottom bracket 140 is fixed into the opening 112. Therefore, in the present embodiment, the components in the connection port assembly 100*a* may be connected to the bottom bracket 140 and then indirectly connected to the body 110; besides, the components in the connection port assembly 100*a* may move in relative to the body 110. However, the invention is not limited thereto.

The door 120 is located next to the opening 112 and pivoted to the bottom bracket 140, such that the door 120 may be rotated in relative to the body 110 for exposing or covering the opening 112. The connection module 130 is located within the opening 112 and slidably connected to the bottom bracket 140, such that the connection module 130 may slide on the inside and outside of the opening 112 in relative to the body 110.

With reference to FIG. 2, in the present embodiment, the connection module 130 includes a casing 132, connection ports 134, and a circuit board 136. The casing 132 is connected to the door 120 and slidably connected to the bottom bracket 140, such that the casing 132 may slide in relative to the body 110. The connection ports 134 and the circuit board 136 are located within the casing 132 and mounted on the circuit board 136, such that external devices (not shown) may be connected to the circuit board 136 through the connection ports 134. The connection module 130 slides on the inside and outside of the opening 112 in relative to the body 110, and thereby the connection module 130 may cover or expose the connection ports 134 at the opening 112. In the present embodiment, the connection module 130 has five connection ports 134, while the type and the number of the connection ports 134 are not limited in the invention.

Besides, in the present embodiment, the connection port assembly 100*a* of the electronic device 100 has two sets of sliding modules 150 that are respectively located at two sides of the body 110 and connected to two ends of the connection module 130. Each sliding module 150 includes a sliding bracket 152 and a sliding shaft 154, wherein the sliding brackets 152 are fixed to two ends of the bottom bracket 140 respectively and fixed to the casing 132 of the connection module 130. Besides, the sliding bracket 152 is coupled to the corresponding sliding shaft 154. Therefore, the connection module 130 slides along the sliding shaft 154 through the sliding bracket 152, such that the connection module 130 is driven to slide in relative to the body 110, and that the two ends of the connection module 130 may slide on the inside and outside of the opening 112 in a balanced manner.

In another aspect, with reference to FIG. 1 and FIG. 2, according to the present embodiment, the connection port assembly 100*a* of the electronic device 100 has two levers 160 that are respectively located at two sides of the opening 112 of the body 110 and connected to the two ends of the connection module 130. Particularly, one end of each lever 160 is pivoted to the bottom bracket 140, and the other end of the lever 160 is pivotally and slidably connected to the casing 132 of the connection module 130. Each lever 160 has a sliding axle 162, and the casing 132 has a sliding groove 132*a* corresponding to the sliding axle 162. Thereby, each lever 160 may be rotated and slid along the sliding groove 132*a* through the sliding axle 162 and drives the connection module 130 to slide on the inside and outside of the opening 112.

The levers 160 of the connection port assembly 100*a* are respectively connected to the two ends of the connection module 130, such that a sliding direction X of the connection module 130 may be restricted to be perpendicular to a length direction Y of the connection module 130. That is, when the connection module 130 slides on the inside and outside of the opening 112, the levers 160 allow the two sides of the connection module 130 to slide in relative to the body 110, such that the connection module 130 is moved along the sliding direction X that is perpendicular to the length direction Y of the connection module 130.

With reference to FIG. 2, according to the present embodiment, the connection port assembly 100*a* of the electronic device 100 has two elastic members 170 that are respectively located at the two sides of the body 110 and connected between the bottom bracket 140 and the connection module 130. When the connection module 130 slides on the inside and outside of the opening 112, the elastic members 170 are pressed and deformed, and a resultant restoring force is then provided by the deformed elastic members 170 to drive the connection module 130 to slide in relative to the body 110. However in other embodiments of the invention, the connection port assembly 100*a* may be equipped with one elastic member 170 or more than two elastic members 170, and the number of the elastic members 170 is not limited in the invention.

It should be mentioned that the elastic members 170 serve to provide the restoring force generated when the connection module 130 slides in relative to the bottom bracket 140 to press and deform the elastic members 170, and the restoring force allows the connection module 130 to automatically slide to a fixed position. Hence, in the present embodiment, two elastic members 170 are disposed at two sides of the body 110 and along the length direction Y of the connection module 130, and the resultant force generated by the elastic force of the elastic members 170 has a direction facing the sliding direction X of the connection module 130, such that the two sides of the connection module 130 may simultaneously slide along the sliding direction X in relative to the body 110.

Figure 3B:
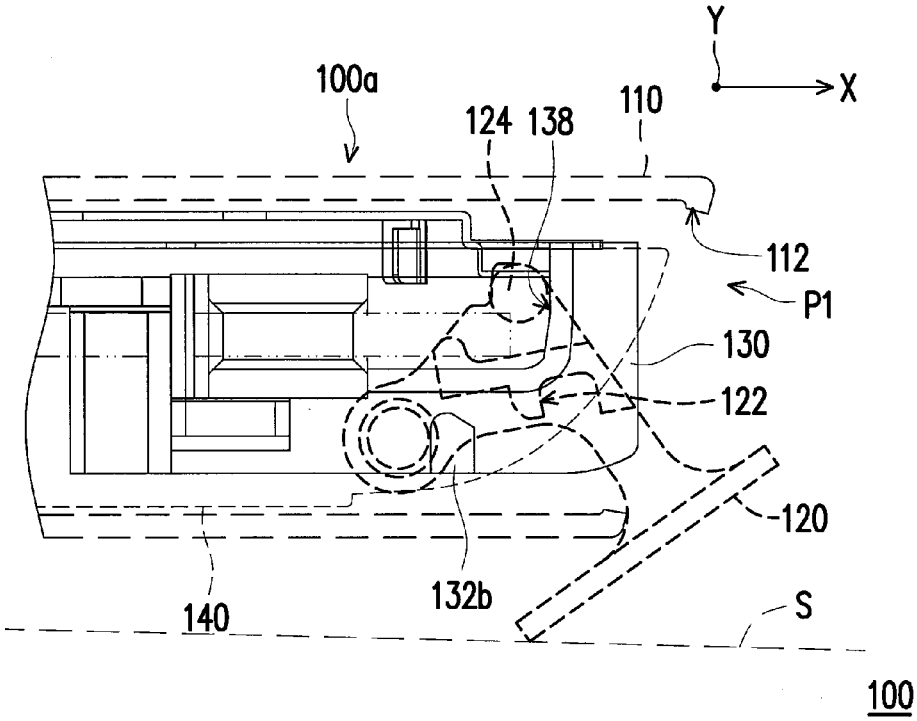
FIG. 3B and FIG. 3C are partial side views illustrating the rotation of the door in relative to the body of the electronic device depicted in FIG. 3A.
Figure 3C:
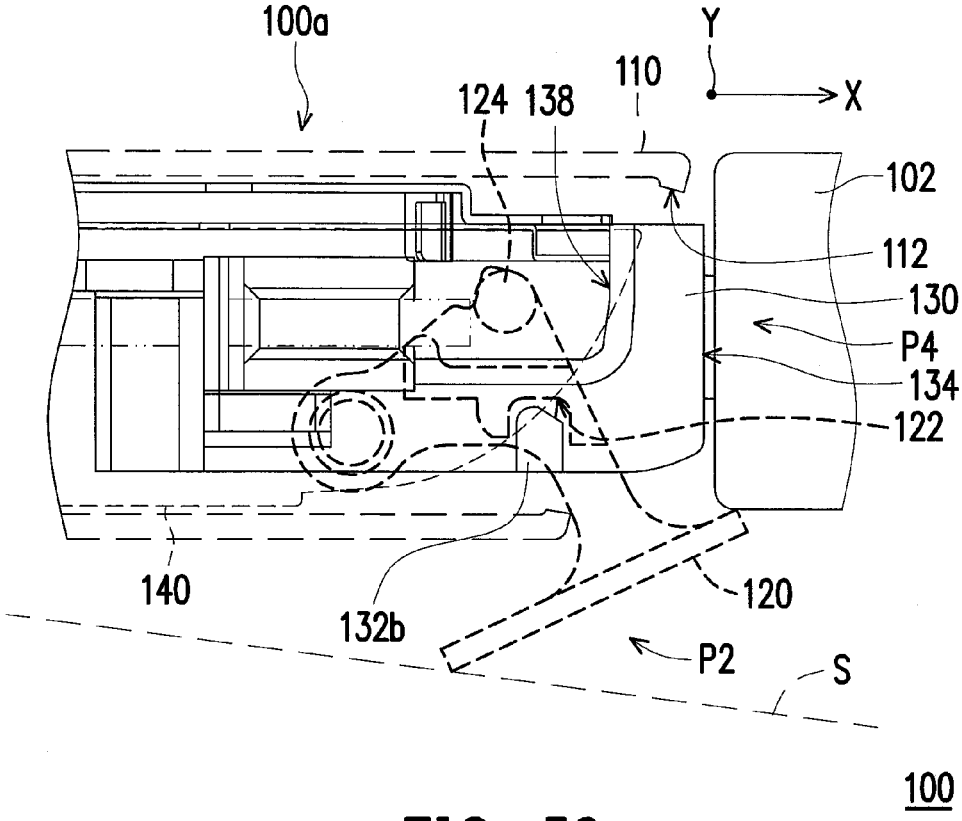

FIG. 3B and FIG. 3C are partial side views illustrating the rotation of the door in relative to the body of the electronic device depicted in FIG. 3A. With reference to FIG. 3A to FIG. 3C, in the present embodiment, the door 120 may be rotated between a closing position P1 and an opening position P2 in relative to the body 110, so as to cover or expose the opening 112. Besides, the connection module 130 may be driven to slide between a retracted position P3 and a working position P4 in relative to body 110, so as to cover or expose the connection ports 134.

In addition, when the connection module 130 slides from the retracted position P3 to the working position P4, the connection module 130 passes through a first transition position P5. As described above, the relative movement of the connection module 130 and the bottom bracket 140 may press and deform the elastic members 170, and the resultant restoring force generated by the deformed elastic members 170 pushes the connection module 130 to slide to a fixed position. When the restoring force starts to be exerted on the connection module 130 that slides from the retracted position P3 to the working position P4, the position where the connection module 130 is located refers to the first transition position P5. Accordingly, FIG. 3A to FIG. 3C schematically and sequentially illustrate the connection module 130 in the retracted position P3, in the first transition position P5, and in the working position P4 when the door 120 is rotated from the closing position P1 to the opening position P2.

In particular, as shown in FIG. 3A, when the door 120 is in the closing position P1, the connection module 130 is in the retracted position P3 in the body 110. At this time, the door 120 covers the opening 112, and the connection module 130 is hidden behind the covered opening 112. Thereby, the connection ports 134 of the connection module 130 may be retracted back to the body 110 and will not be contaminated by dust.

With reference to FIG. 3B, when the door 120 in the closing position P1 is rotated in relative to the body 110 and drives the connection module 130 to slide from the retracted position P3 to the first transition position P5 in relative to the body 110, the door 120 exposes a portion of the opening 112. While the connection module 130 is sliding, the elastic members 170 disposed between the bottom bracket 140 and the connection module 130 are pressed and deformed because of the relative movement of the bottom bracket 140 and the connection module 130.

With reference to FIG. 3C, after the connection module 130 slides in relative to the body 110 to the first transition position P5, the pressed and deformed elastic members 170 provide the restoring force to drive the connection module 130 to slide in relative to the body 110 to the working position P4, and the connection module 130 drives the door 120 to rotate in relative to the body 110 to the opening position P2. At this time, the connection module 130 is located outside the opening 112 and exposes the connection ports 134, such that a user on the outside of the electronic device 100 is able to connect external devices to the connection ports 134.

With reference to FIG. 2 and FIG. 3A to FIG. 3C, in the present embodiment, the door 120 has two positioning recessions 122 that are respectively located at two sides of the door 120; the connection module 130 has two positioning protrusions 132*b* that are respectively located on the casing 132 of the connection module 130 and correspond to the positioning recessions 122.

When the door 120 is rotated to the opening position P2 in relative to the body 110 and drives the connection module 130 to slide to the working position P4 in relative to the body 110, the positioning protrusions 132*b* together with the connection module 130 slide out of the body 110, and the positioning recessions 122 are rotated together with the door 120, such that the positioning protrusions 132*b* are mounted to the positioning recessions 122. As shown in FIG. 3C, through the positioning protrusions 132*b*, the positioning recessions 122 of the door 120 fix the connection module 130 in relative to the body 110 to the working position P4.

At this time, when a user connects an external connection head 102 of an external device to the connection ports 134 and exerts a force on the connection module 130 in a direction opposite to the sliding direction X, the positioning recessions 122 are unable to move along the direction opposite to the sliding direction X in relative to the positioning protrusions 132*b*, such that the connection module 130 that moves together with the door 120 is fixed to the working position P4 and is not pushed back to the body 110. Besides, when the external connection head 102 is connected to the connection ports 134 of the connection module 130, the external connection head 102 interferes with the door 120 in the opening position P2. At this time, the door 120 is unable to be rotated in relative to the body 110 and thus stays at the opening position P2.

With reference to FIG. 3A to FIG. 3C, in the present embodiment, the electronic device 100 is exemplarily located on a working surface S that is a tabletop or a planar surface suitable for holding and operating the electronic device 100, which should not be construed as a limitation to the invention. When the door 120 is rotated from the closing position P1 to the opening position P2 in relative to the body 110, the bottom of the door 120 leans against the working surface S, such that the body 110 is pushed away from the working surface S, which is shown in FIG. 3A to FIG. 3C. Here, the working surface S shown in FIG. 3A to FIG. 3C is actually located on the same horizontal plane, and the reason for illustrating the working surface S at different inclination angles is to clearly show the relative positions of the body 110, the door 120, the connection module 130, and other components from the same viewing angle. This does not indicate that the working surface S is a movable surface.

Figure 4:
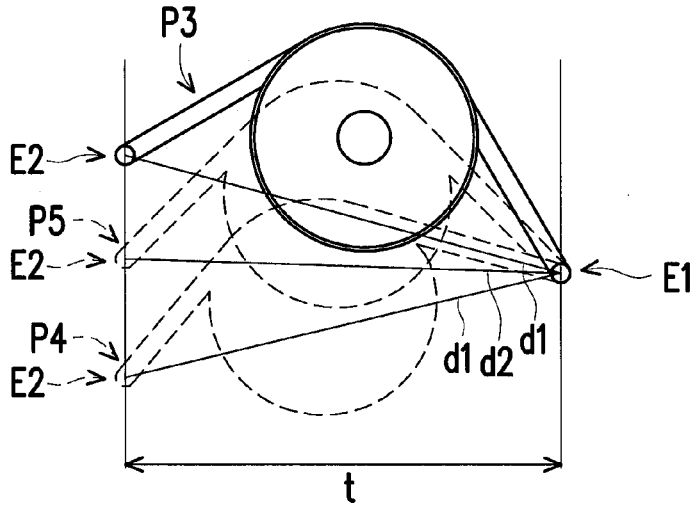
FIG. 4 is a schematic view illustrating the elastic member depicted in FIG. 2.

FIG. 4 is a schematic view illustrating the elastic member depicted in FIG. 2. With reference to FIG. 2 and FIG. 4, in the present embodiment, the elastic members 170 are torsion springs which are symmetrically disposed at respective sides of the body 110 and located between the bottom bracket 140 and the connection module 130. The first end E1 of each elastic member 170 is fixed to the bottom bracket 140, the second end E2 of each elastic member 170 is fixed to the casing 132, and there is a fixed distance t between the first and second ends E1 and E2 in the length direction Y. Hence, when the door 120 is rotated in relative to the body 110 and drives the connection module 130 to slide in relative to the body 110, the two ends E1 and E2 of the elastic member 170 are deformed because of said relative movement.

To be specific, when the door 120 is in the closing position P1, and the connection module 130 is in the retracted position P3, the first and second ends E1 and E2 of the elastic member 170 are not moved relatively and are not deformed. When the door 120 is rotated in relative to the body 110 and drives the connection module 130 to slide along the sliding direction X in relative to the body 110 to the first transition position P5, the second end E2 of the elastic member 170 is moved in relative to the first end E1 of the elastic member 170 because of the sliding movement of the connection module 130. At this time, the elastic member 170 is deformed, such that the distance between the first and second ends E1 and E2 is changed from d1 to d2.

After the connection module 130 slides in relative to the body 110 to the first transition position P5, the pressed and deformed elastic member 170 releases the restoring force, such that the distance between the first and second ends E1 and E2 is changed from d2 back to d1. Here, the second end E2 on which the restoring force is exerted drives the connection module 130 to slide in relative to the body 110 along the sliding direction X to the working position P4, and the connection module 130 drives the door 120 to rotate in relative to the body 110 to the opening position P2.

When the connection module 130 in the retracted position P3 is driven by the door 120 and slides in relative to the body 110, once the connection module 130 has not arrived at the first transition position P5 but the door 120 no longer drives the connection module 130 to move, the connection module 130 affected by the restoring force of the elastic members 170 may return to the retracted position P3. Namely, the connection module 130 need be driven by the door 120 and slide in relative to the body 110 to the first transition position P5, and the restoring force of the elastic member 170 may then push the connection module 130 to slide in relative to the body 110 to the working position P4.

Figure 5A:
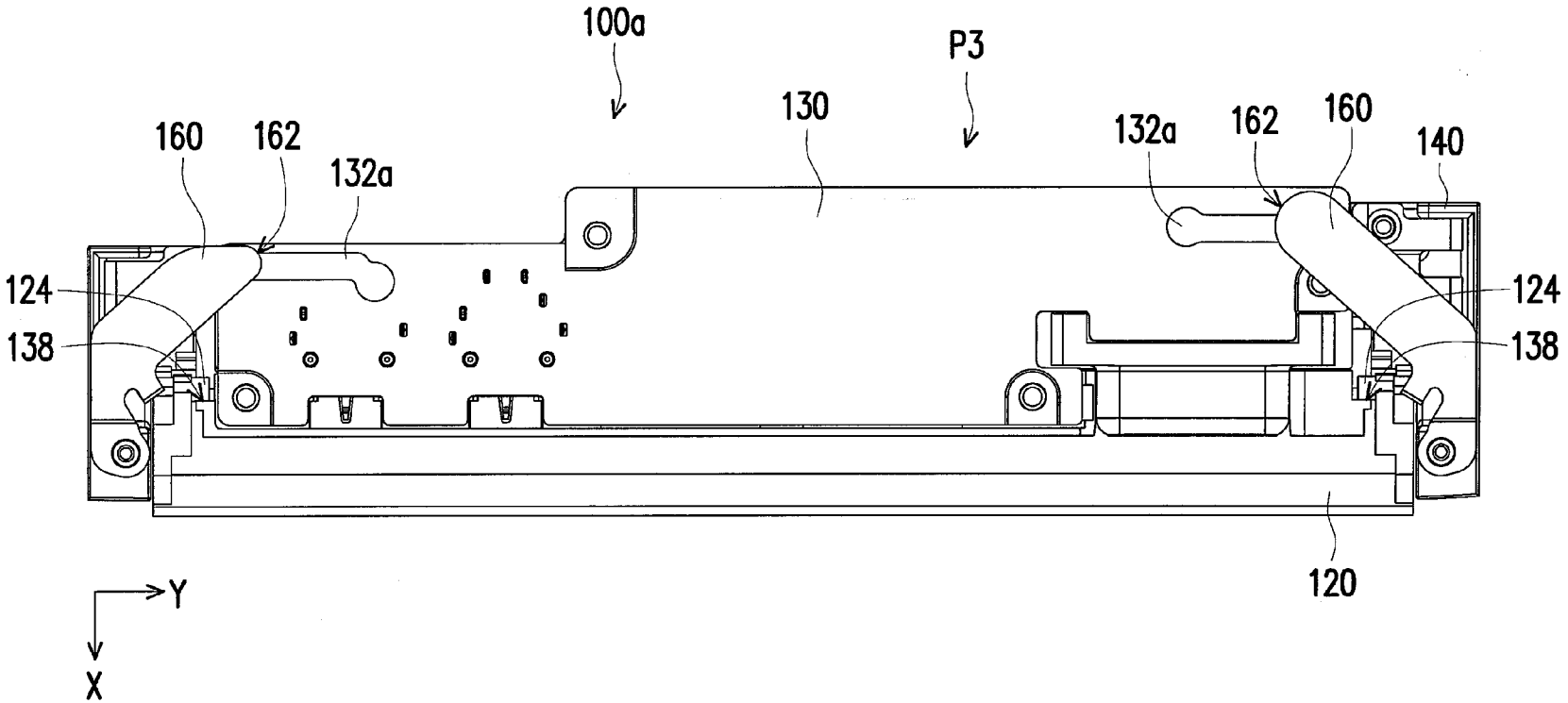
FIG. 5A to FIG. 5C are top views illustrating the connection port assembly depicted in FIG. 3A to FIG. 3C.
Figure 5B:
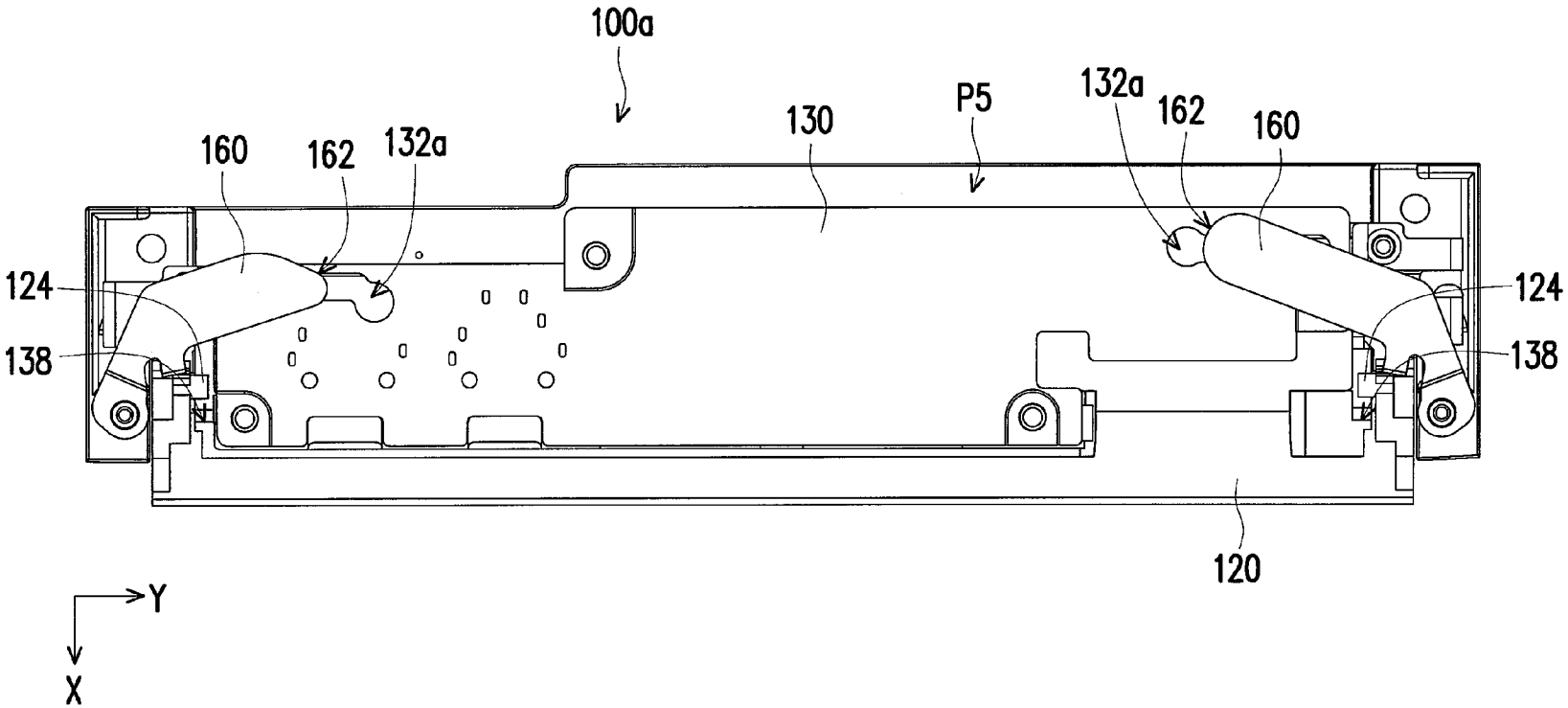
Figure 5C:
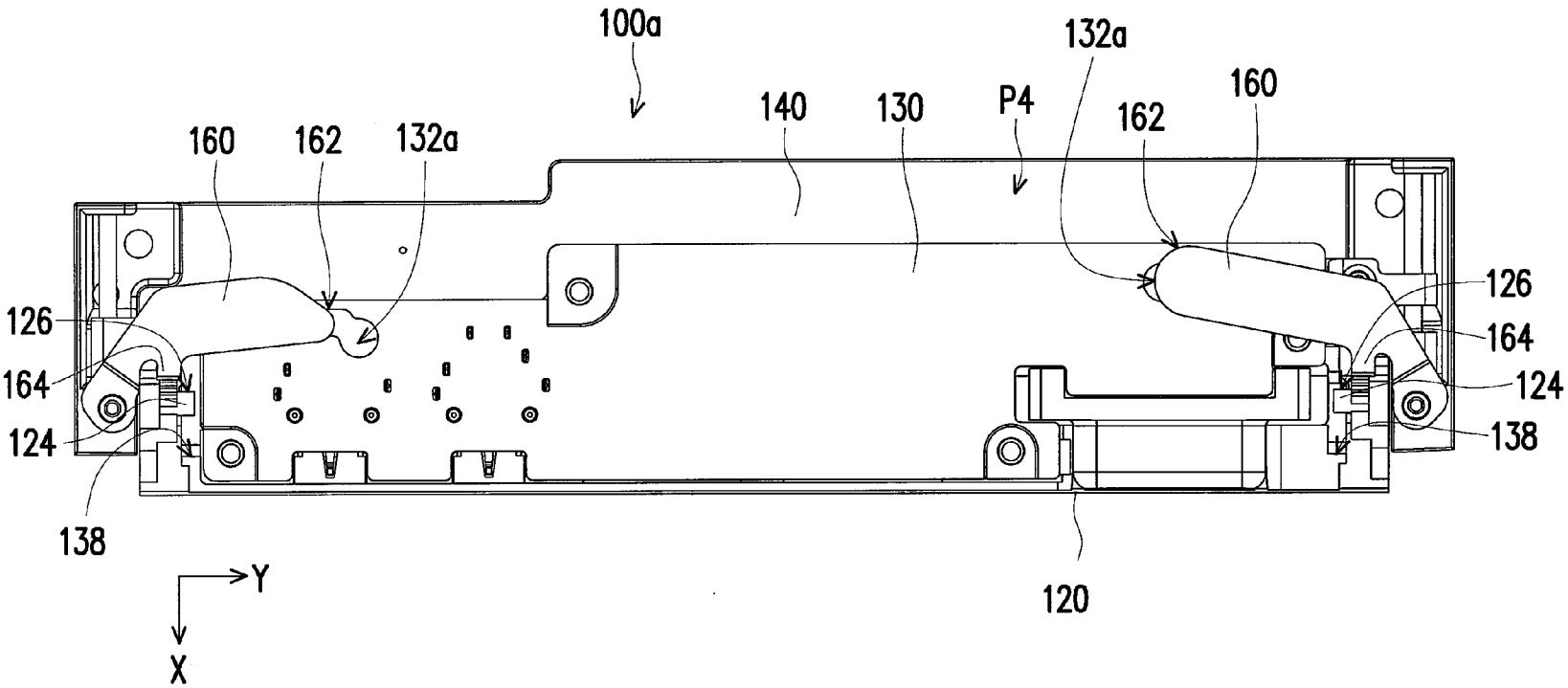

FIG. 5A to FIG. 5C are top views illustrating the connection port assembly depicted in FIG. 3A to FIG. 3C. With reference to FIG. 2 and FIG. 5A to FIG. 5C, in the present embodiment, the door 120 has the driving protrusions 124, and the connection module 130 has the driving recessions 138 that are fit with the driving protrusions 124. When the door 120 is rotated in relative to the body 110, the driving protrusions 124 are rotated in relative to the driving recessions 138 and drive the connection module 130 to slide on the inside and outside of the opening 112 in relative to the body 110.

Particularly, when the door 120 is in the closing position P1 and the connection module 130 is in the retracted position P3, the sliding axles 162 of the levers 160 are located on outer sides of the sliding grooves 132*a* on the casing 132, and the driving protrusions 124 of the door 120 are fit with the driving recessions 138 of the connection module 130, as shown in FIG. 3A and FIG. 5A.

When the door 120 is rotated in relative to the body 110 and drives the connection module 130 to slide in relative to the body 110 along the sliding direction X to the first transition position P5, the connection module 130 drives the levers 160 to rotate in relative to the body 110, the sliding axles 162 are rotated in the sliding grooves 132*a* and drive the levers 160 to move toward inner sides of the sliding grooves 132*a* along the sliding grooves 132*a*, and the driving protrusions 124 are rotated in relative to the driving recessions 138 and push the connection module 130 to slide in relative to the body 110 toward the sliding direction X, as shown in FIG. 3B and FIG. 5B.

After the connection module 130 slides in relative to the body 110 to the first transition position P5, the restoring force of the elastic members 170 pushes the connection module 130 to slide in relative to the body 110 along the sliding direction X to the working position P4. Through the relative movement of the sliding grooves 132*a* and the sliding axles 162, the connection module 130 drives the levers 160 to rotate in relative to the body 110, and the levers 160 are moved to the inner sides of the sliding grooves 132*a* through the sliding axles 162. At this time, the driving recessions 138 together with the connection module 130 are moved toward the outside of the body 110 and are thus no longer in contact with the driving protrusions 124, as shown in FIG. 3C and FIG. 5C.

During said process, i.e., when the door 120 in the closing position P1 is rotated in relative to the body 110 to the opening position P2 and drives the connection module 130 to slide in relative to the body 110 from the retracted position P3 to the first transition position P5, and the connection module 130 affected by the restoring force of the elastic members 170 then slides to the working position P4, the levers 160 located at two sides of the body 110 may help the connection module 130 slide toward the sliding direction X in a balanced manner. When the door 120 is in the opening position P2 and the connection module 130 is in the working position P4, the connection ports 134 are exposed by the opening 112 of the body 110.

Figure 6:
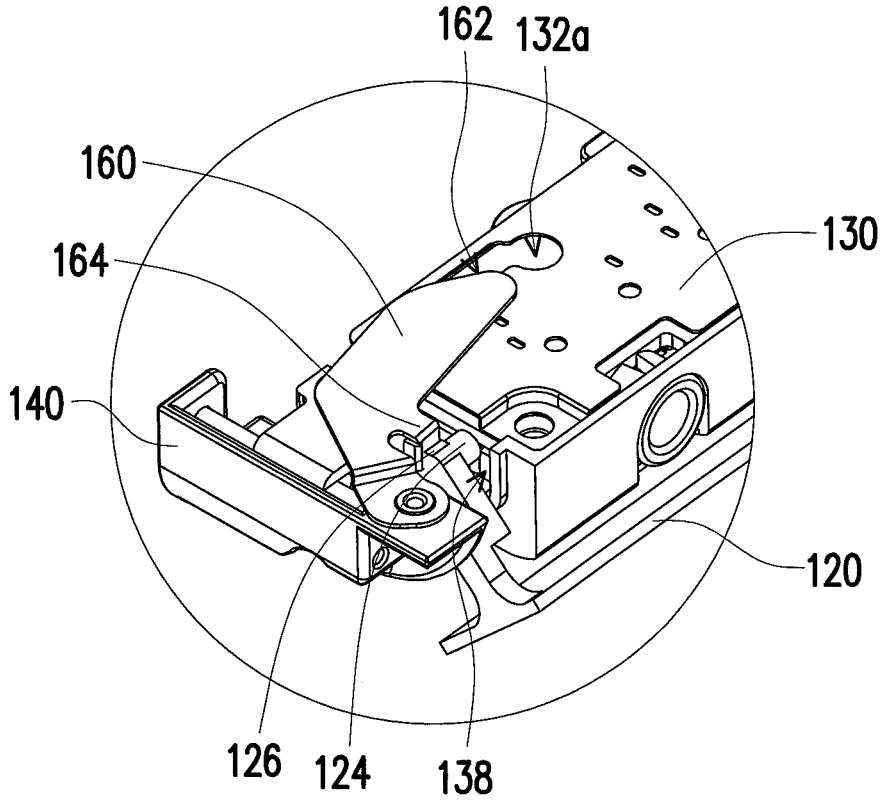
FIG. 6 is an enlarged perspective view illustrating part of the connection port assembly depicted in FIG. 5C.

FIG. 6 is an enlarged perspective view illustrating part of the connection port assembly depicted in FIG. 5C. With reference to FIG. 2 and FIG. 6, in the present embodiment, the lever 160 has a driven portion 164, and the door 120 has a driving portion 126. When the door 120 is rotated to the opening position P2 in relative to the body 110 and drives the connection module 130 to slide to the working position P4 in relative to the body 110, the connection module 130 drives the lever 160 to rotate in relative to the body 110, such that the driven portion 164 approaches the driving portion 126. When the door 120 is in the opening position P2 and the connection module 130 is in the working position P4, the driven portion 164 of the lever 160 is located on one side of the driving portion 126 of the door 120. Accordingly, when the door 120 is rotated in relative to the body 110 from the opening position P2 to the closing position P1 for covering the opening 112, the driving portion 126 of the door 120 is, together with the door 120, rotated in relative to the body 110, such that the driving portion 126 is in contact with the driven portion 164 of the lever 160 and pushes the driven portion 164 to drive the connection module 130 to slide in relative to the body 110, as shown in FIG. 6.

Figure 7A:
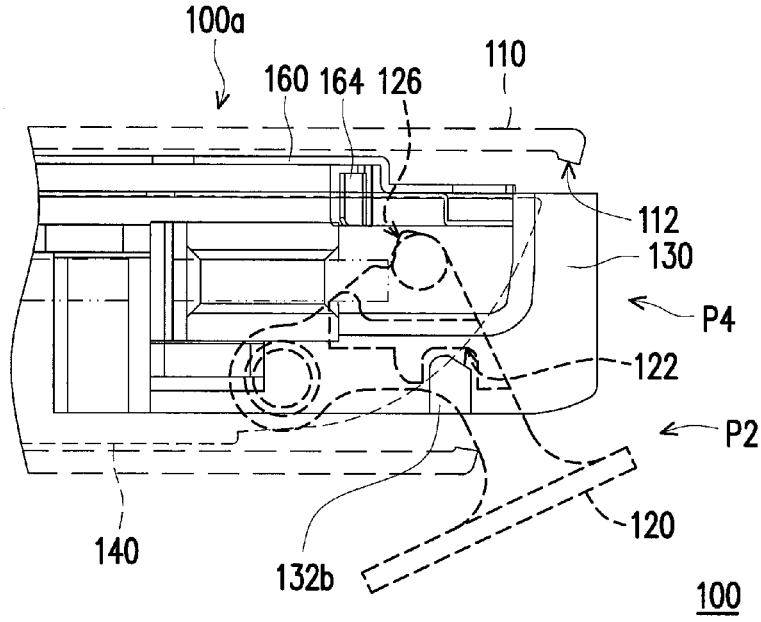
FIG. 7A to FIG. 7C are partial side views illustrating the door of the electronic device depicted in FIG. 1.
Figure 7B:
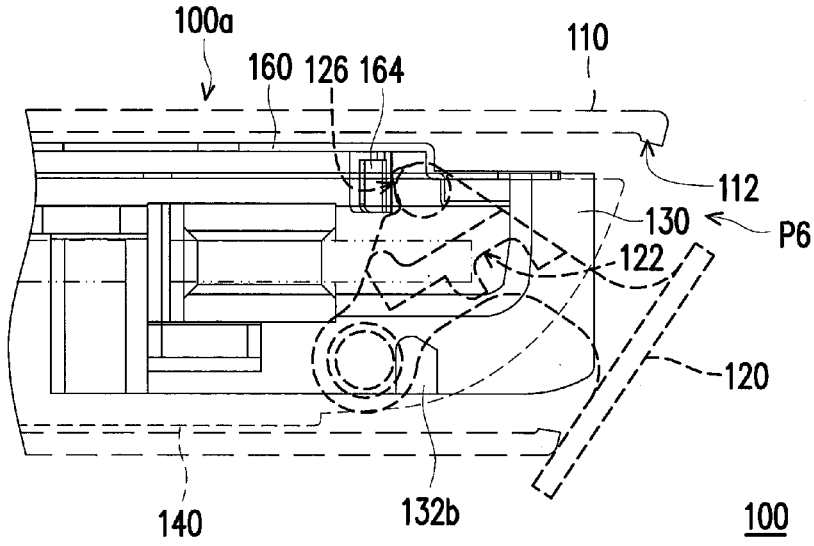
Figure 7C:
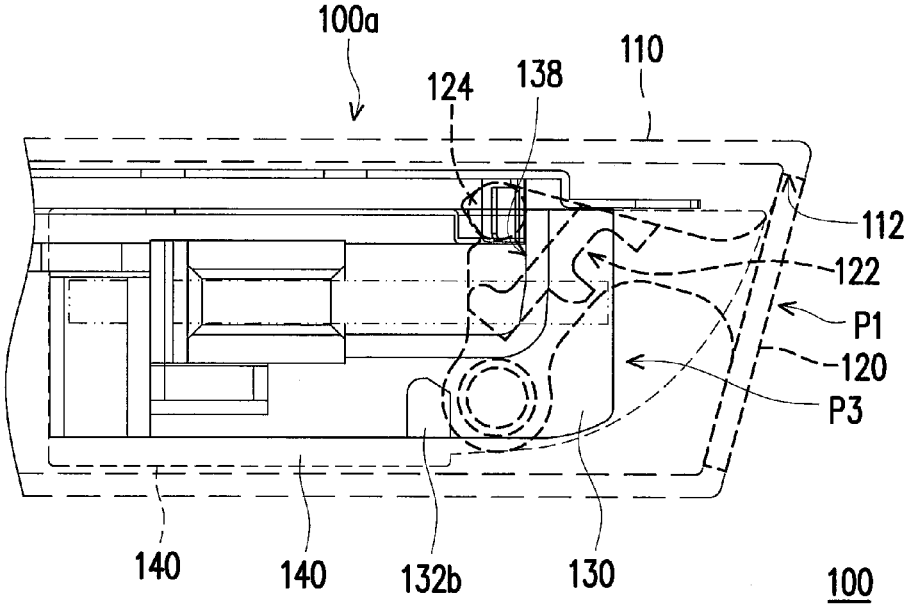

FIG. 7A to FIG. 7C are partial side views illustrating the door of the electronic device depicted in FIG. 1. With reference to FIG. 7A to FIG. 7C, when the door 120 is rotated from the opening position P2 to the closing position P1, the door 120 drives the connection module 130 to slide from the working position P4 to the retracted position P3. When the connection module 130 slides from the working position P4 to the retracted position P3, the connection module 130 passes through a second transition position P6. As described above, the relative movement of the connection module 130 and the bottom bracket 140 may press and deform the elastic members 170, and the resultant restoring force generated by the deformed elastic members 170 pushes the connection module 130 to slide to a fixed position. When the restoring force starts to be exerted on the connection module 130 that slides from the working position P4 to the retracted position P3, the position where the connection module 130 is located refers to the second transition position P6. Accordingly, FIG. 7A to FIG. 7C schematically and sequentially illustrate the connection module 130 in the working position P4, in the second transition position P6, and in the retracted position P3 when the door 120 is rotated from the opening position P2 to the closing position P1.

In particular, when the door 120 is in the opening position P2, the connection module 130 is in the working position P4. At this time, the door 120 exposes the opening 112, and the connection module 130 is exposed to the external surroundings by the opening 112, as shown in FIG. 7A. When a user intends to retract the connection ports 134 back to the electronic device 100, the door 120 in the opening position P2 is rotated in relative to the body 110, such that the positioning protrusions 132*b* are no longer mounted to the positioning recessions 122 as the door 120 is rotated, and that the driving portion 126 of the door 120 pushes the driven portions 164 of the levers 160. The driven portions 164 of the levers 160 are pushed and rotated in relative to the body 110, and the sliding axles 162 of the levers 160 are rotated along the sliding grooves 132*a* and moved toward the outside of the sliding grooves 132*a*. As shown in FIG. 7B, the door 120 and the levers 160 drive the connection module 130 to slide in relative to the body 110 from the working position P4 to the second transition position P6, and the connection module 130 is driven to push the elastic members 170.

After the connection module 130 slides in relative to the body 110 to the second transition position P6, the restoring force generated by the pressed and deformed elastic members 170 drives the connection module 130 to slide in relative to the body 110 to the retracted position P3. At this time, the restoring force generated by the pressed and deformed elastic members 170 pushes the connection module to slide toward the opening 112 of the body 110 and drives the levers 160 to move toward the outside of the sliding grooves 132*a* through the sliding grooves 132*a* of the connection module 130. The driving recessions 138 of the connection module 130 lean against the driving protrusions 124 of the door 120 and push the driving protrusions 124 to rotate, such that the door 120 is driven to be rotated in relative to the body 110 to the closing position P1, as shown in FIG. 7C.

When the connection module 130 in the working position P4 is driven by the door 120 and slides in relative to the body 110, once the connection module 130 has not arrived at the second transition position P6 but the door 120 no longer drives the connection module 130 to move, the connection module 130 affected by the restoring force of the elastic members 170 may return to the working position P4. Namely, the connection module 130 need be driven by the door 120 and slide in relative to the body 110 to the first transition position P5, and the restoring force of the elastic member 170 may then push the connection module 130 to slide in relative to the body 110 to the working position P4.

Through the restoring force of the elastic members 170, the connection module 130 slides in relative to the body 110 to the retracted position P3 and covers the connection ports 134, and the door 120 is rotated in relative to the body 110 to the closing position P1 and covers the opening 112. Thereby, when the user does not intend to use the connection ports 134, the connection ports 134 may be retracted back to the body 110 and will not be contaminated by dust.

To sum up, the electronic device described herein has the body with an opening where the connection module is located, and the door is pivoted to the body and capable of rotating in relative to the body for exposing or covering the opening When the door is rotated in relative to the body and exposes the opening, the door drives the connection module to slide out of the body to expose the connection ports; when the door is rotated in relative to the body and covers the opening, the door drives the connection module to slide into the body to cover the connection ports.

Moreover, while the connection module is sliding, the elastic members disposed between the bottom bracket and the connection module are pressed and deformed because of the relative movement of the bottom bracket and the connection module, and the restoring force generated by the deformed elastic members pushes the connection module to slide. Accordingly, when a user intends to use the connection ports, the door may be rotated in relative to the body and drive the connection module to slide in relative to the body, so as to expose the connection ports. When the user does not intend to use the connection ports, the door may be rotated in relative to the body and drive the connection module to slide in relative to the body, so as to cover the connection ports and prevent the connection ports from dust contamination.

Although the invention has been described with reference to the above embodiments, it will be apparent to one of the ordinary skill in the art that modifications to the described embodiment may be made without departing from the spirit of the invention. Accordingly, the scope of the invention will be defined by the attached claims not by the above detailed descriptions.

What is claimed is:

1. An electronic device comprising:

a body having an opening located at a side of the body;

a door pivoted to the body, the door being capable of rotating between an opening position and a closing position in relative to the body to expose or cover the opening; and a connection module slidably connected to the body, wherein when the door is rotated to the opening position in relative to the body and exposes the opening, the door drives the connection module to slide to a working position in relative to the body, and when the door is rotated to the closing position in relative to the body and covers the opening, the door drives the connection module to slide to a retracted position in relative to the body; and a sliding module connected to the body and the connection module, such that the connection module is slidably connected to the body through the sliding module; wherein the sliding module comprises a sliding bracket and a sliding shaft, the sliding shaft is fixed to the body, the sliding bracket is fixed to the connection module and coupled to the sliding shaft, and the connection module slides along the sliding shaft through the sliding bracket, such that the connection module is driven to slide in relative to the body.

2. The electronic device as recited in claim 1, wherein the door has a driving protrusion, the connection module has a driving recession fit with the driving protrusion, and when the door is rotated to the opening position in relative to the body, the driving protrusion is rotated in relative to the driving recession and drives the connection module to slide to the working position in relative to the body.

3. The electronic device as recited in claim 1, wherein the door has a positioning recession, the connection module has a positioning protrusion, and when the door is rotated to the opening position in relative to the body and drives the connection module to slide to the working position in relative to the body, the positioning protrusion is mounted to the positioning recession, such that the connection module is fixed to the working position in relative to the body.

4. The electronic device as recited in claim 1, further comprising:

a bottom bracket fixed into the body, wherein the door is pivoted to the bottom bracket, and the connection module is slidably connected to the bottom bracket.

5. The electronic device as recited in claim 1, wherein when an external connection head is connected to the connection module, the external connection head interferes with the door, such that the door stays at the opening position.

6. The electronic device as recited in claim 1, wherein when the door is in the opening position, the door pushes the body away from a working surface.

7. The electronic device as recited in claim 1, wherein the connection module comprises a casing and at least one connection port, the casing is slidably connected to the body and connected to the door, the at least one connection port is disposed in the casing, when the door is rotated to the opening position in relative to the body, the door drives the connection module to slide to the working position in relative to the body to expose the at least one connection port, and when the door is rotated to the closing position in relative to the body, the door drives the connection module to slide to the retracted position in relative to the body to cover the at least one connection port.

8. The electronic device as recited in claim 7, wherein the connection module further comprises a circuit board disposed in the casing, and the at least one connection port is mounted on the circuit board.

9. The electronic device as recited in claim 1, further comprising:

an elastic member disposed between the body and the connection module, wherein after the door in the closing position is rotated in relative to the body and drives the connection module to slide in relative to the body from the retracted position to a transition position to deform the elastic member, the elastic member drives the connection module to slide to the working position in relative to the body, so as to drive the door to rotate to the opening position in relative to the body, and after the door in the opening position is rotated in relative to the body and drives the connection module to slide in relative to the body from the working position to the transition position to deform the elastic member, the elastic member drives the connection module to slide to the retracted position in relative to the body, so as to drive the door to rotate to the closing position in relative to the body.

10. The electronic device as recited in claim 9, wherein the elastic member is a torsion spring.

11. The electronic device as recited in claim 1, further comprising:

a lever, one end of the lever being pivoted to the body, the other end of the lever being pivotally and slidably connected to the connection module, the lever having a driven portion, the door having a driving portion, wherein when the door is rotated to the closing position in relative to the body, the driving portion of the door pushes the driven portion of the lever, such that the connection module is driven to slide to the retracted position in relative to the body.

12. The electronic device as recited in claim 11, wherein the number of the lever is two, and the levers are respectively pivoted to two ends of the opening of the body and pivotally and slidably connected to two ends of the connection module, so as to restrict the connection module to slide in relative to the body in a direction perpendicular to a length direction of the connection module.

13. The electronic device as recited in claim 12, wherein the connection module has a sliding groove, the lever has a sliding axle, and the lever is rotated and slid along the sliding groove through the sliding axle and drives the connection module.

* * * * *